US005823102A

United States Patent [19]

Will

[11] Patent Number: 5,823,102

[45] Date of Patent: Oct. 20, 1998

[54] FRESH FOOD DISPLAY PROTECTOR

[75] Inventor: Robert E. Will, Fort Washington, Pa.

[73] Assignee: Fletcher Super Rack Industries, Inc., Fort Washington, Pa.

[21] Appl. No.: 790,108

[22] Filed: Jan. 29, 1997

[51] Int. Cl.[6] ..... A47B 96/18

[52] U.S. Cl. ..... 99/645; 312/140.4; 312/229; 108/152

[58] Field of Search ..... 99/645; 312/114, 312/116, 140.4, 284, 137, 229; 108/102, 61, 96, 137, 143, 152; 135/90, 141, 741

[56] References Cited

U.S. PATENT DOCUMENTS 4,572,598 2/1986 Moore, Jr. ..... 312/284
4,892,366 1/1990 Yerman ..... 312/140.4
5,082,334 1/1992 Beyer et al. ..... 312/140.4
5,584,545 12/1996 LaVaute et al. ..... 312/114 X

*Primary Examiner*—Reginald L. Alexander
*Attorney, Agent, or Firm*—Fitzpatrick, Cella, Harper & Scinto

[57] ABSTRACT

A food display guard or protector is disclosed which includes a support for securing the display guard in a display case. The support includes a vertical support tube and a support mechanism for adjustably mounting the vertical support tube. The guard also includes a generally horizontal support member extending from the vertical support tube which horizontal support member is adjustable in length.

12 Claims, 3 Drawing Sheets

FRESH FOOD DISPLAY PROTECTOR

BACKGROUND OF THE INVENTION

The present invention relates to food display guards or protector, and more in particular to a fresh food display protector which allows the user to adjust the position of the display protector both vertically and horizontally over a food display case.

Food display guards or protectors have been conventionally used to shield foods on salad bars or the like in display cases to protect the food against contamination in the atmosphere and from customer coughing, sneezing or the like. Such display guards typically consist of a fixed mounting arrangement formed as a transparent glass or plastic shield. The prior art display guards suffer from the disadvantage that they are not adjustable and therefore each display guard must be constructed specifically with regard to the dimensions of the particular individual display case it is to be used with.

It is an object of the present invention to provide a food display guard which is relatively simple in construction and adjustable.

Another object of the present invention is to provide an adjustable food display guard which is relatively inexpensive to fabricate.

A still further object of the present invention is to provide an adjustable food display guard which is easily adjustable and capable of being retrofitted into existing display cases.

BRIEF SUMMARY OF THE INVENTION

In accordance with an aspect of the present invention a food display protector or guard is provided which includes a support that can be mounted in an existing display case. The support is adapted to hold a vertical support tube and includes a compression fitting for adjustably mounting the support tube in the support and display case. The vertical support tube includes a generally horizontally extending support member which includes means for adjusting its length. A support for a glass display shield or the like is mounted on the horizontal tube.

The above, and other objects, features and advantages of this invention will be apparent in the following detailed description of illustrative embodiments thereof, which is to be read in connection with the accompanying drawings, wherein:

DETAILED DESCRIPTION OF THE INVENTION

Figure 1:
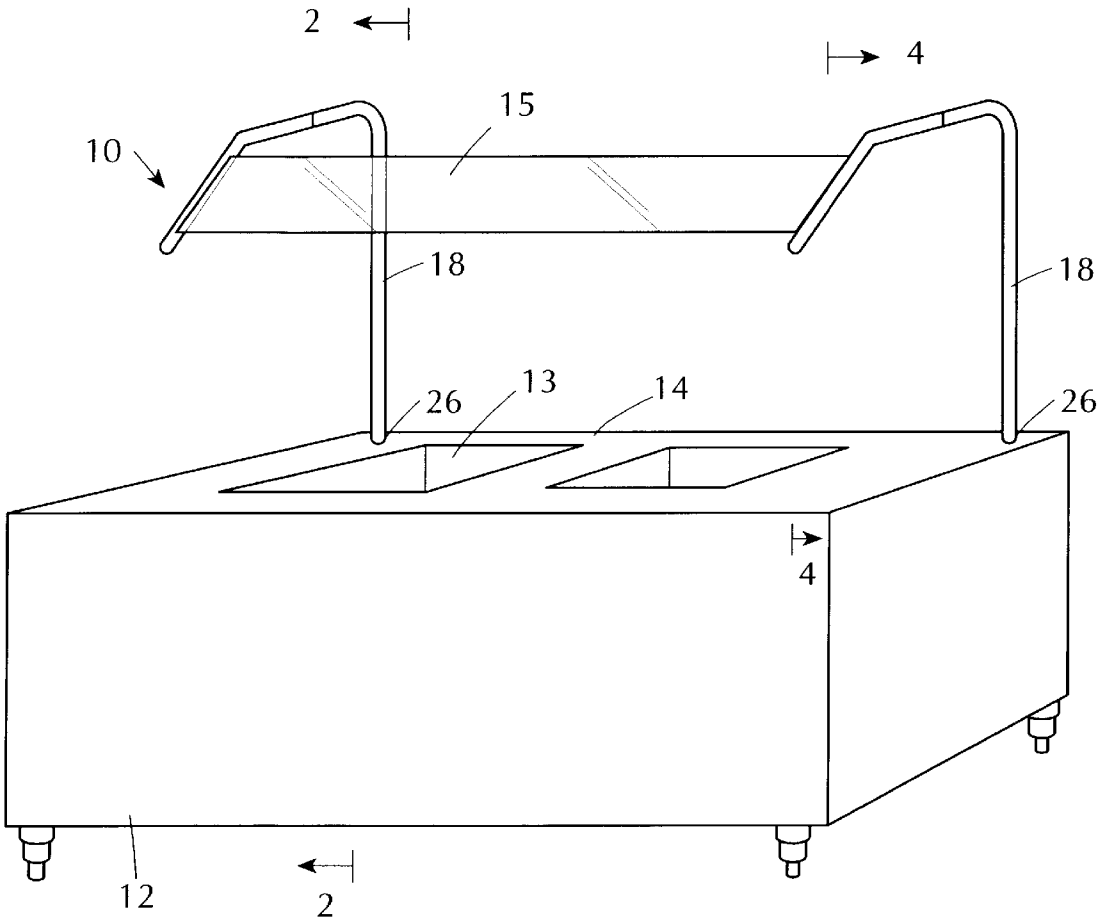
FIG. 1 is a perspective view of a food display case including a food display guard constructed in accordance with the present invention.

Referring now to the drawings in detail, initially to FIG. 1, a food display guard or protector 10 is illustrated mounted on a fresh food display case 12. Display case is of generally conventional construction and is adapted to keep food on display in a cool environment, for example in refrigerated recesses 13 in its top 14. Display guard 10 supports a transparent shield 15 of glass, plastic or the like to shield the food in the display case from contamination by air borne dust or the like.

Food display guard 10 is adjustably mounted for both vertical and horizontal adjustment relative to the products in display case 12. It is also adapted to be retrofitted into existing display cases.

Figure 2:
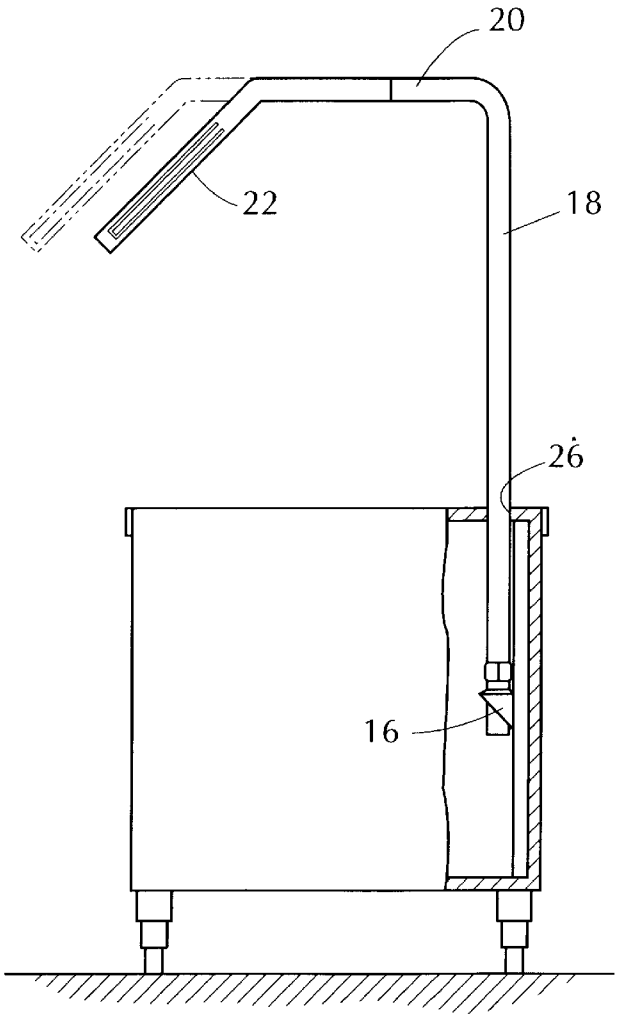
FIG. 2 is a side sectional view of the display case shown in FIG. 1, taken along line 2—2 thereof, illustrating the mounting arrangement for the food display guard and showing the horizontal adjustability of the display guard in phantom lines.

More particularly, as seen in FIG. 2, food display guard 10 includes a support member 16 which supports a vertical tube 18. The vertical tube includes at its upper end a horizontal section 20 which further includes an angled extension 22 that serves to support the glass shield 15. Of course, one display guard support structure is mounted in each end of display case 12 to support shield 15, as seen in FIG. 1.

Figure 6:
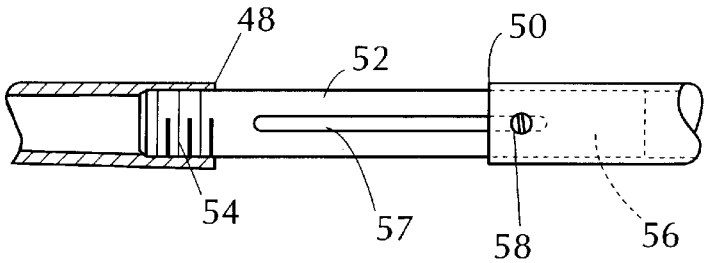
FIG. 6 is a partial top plan view, partly in section, taken along line 6—6 of FIG. 1, illustrating the horizontal adjustment for the food display guard.
Figure 3:
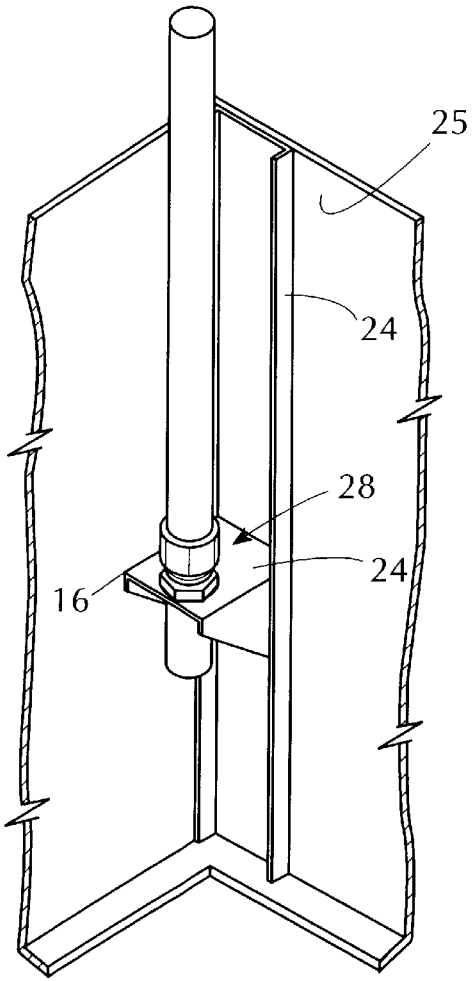
FIG. 3 is an enlarged perspective view of the vertical mounting arrangement for the food display guard of FIG. 1.

As seen more clearly in FIG. 3, support 16 is a bracket which is mounted in a fixed position in a vertical channel 24 in any convenient manner, e.g. by brazing or welding. Vertical channel 24 is in turn secured to the inner wall 25 of display case 12 in any convenient manner, e.g. by tack welding. Channel 24 can be supported on the back wall of the display case, as seen in FIG. 2, or to an end wall of the case as seen in the embodiment of FIG. 6. A guide hole 26 or the like is formed in the upper surface 14 of the display case so that the vertical support tube 18 can pass therethrough. By this arrangement the display guard can be easily installed in an original equipment display case or can be retrofitted in an existing display case.

Figure 4:
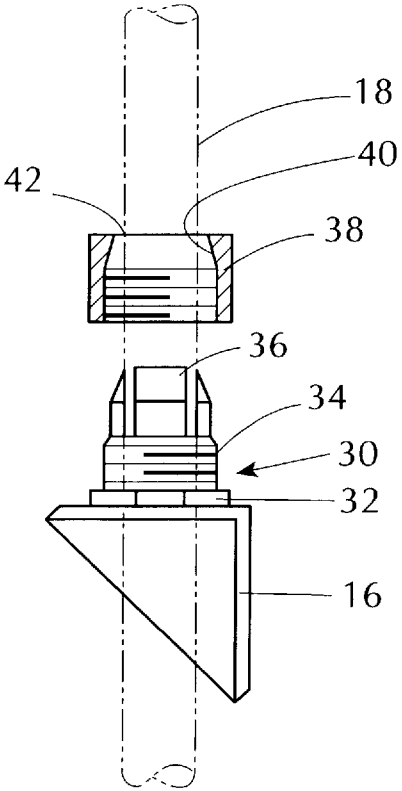
FIG. 4 is an exploded side view of the compression fitting for the vertical adjustment feature of the food display guard.

Vertical support tube 18 is adjustably mounted in support bracket 16 by a compression fitting 28 which is secured to the upper surface 24 of bracket 16. The compression fitting is of conventional construction and includes a threaded collet 30, as seen in FIG. 4. Collet 30 includes a base 32, a threaded section 34 and a plurality of flexible fingers 36 extending therefrom. The collet has a central opening in it which receives the vertical tube 18 (shown in phantom in FIG. 4). A compression nut 38 surrounds tube 18 and is adapted to mate with and engage threaded surface 34 of collet 30. The compression nut includes an interior bore 40 including an inner cam surface 42 which engages collet fingers 36 as the nut is threaded down on threaded section 32. As the nut is tightened, cam surface 42 compresses the fingers 32 against the surface of tube 18 to lock the tube in a selected vertical position. That position can be easily changed by loosening nut 38, adjusting the vertical position of the tube in bracket 16 and retightening nut 38.

Figure 5:
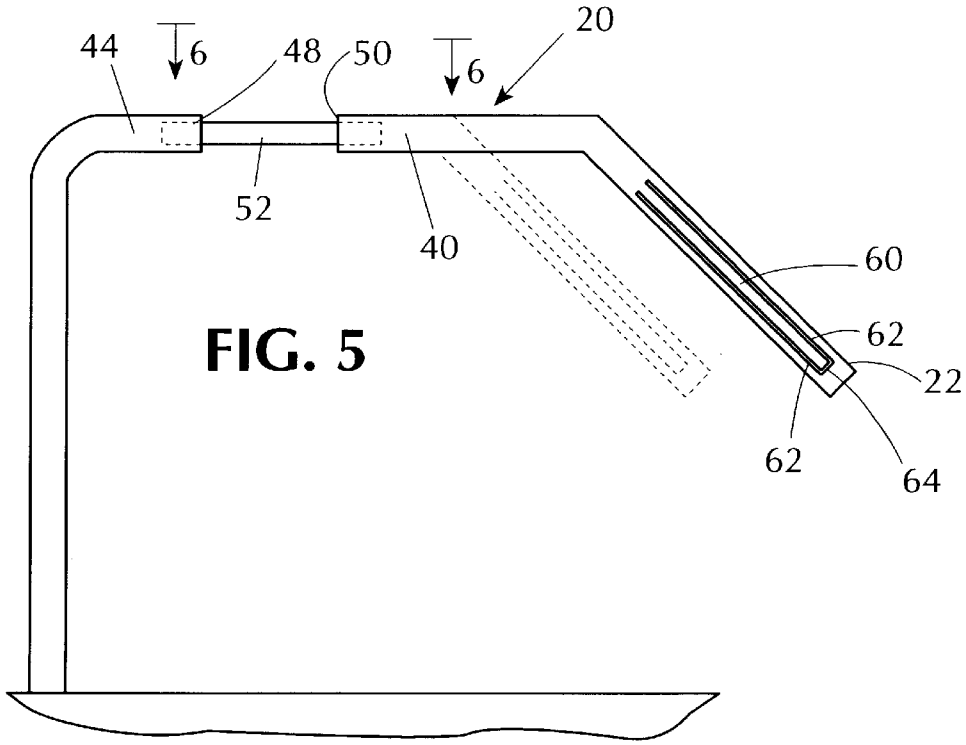
FIG. 5 is an enlarged partial side sectional view of the food display guard, taken along line 4—4 of FIG. 1, showing the horizontal adjustment for the support.

The horizontal section 20 of the display guard includes a first horizontal section 44 integral with tube 18 and a second horizontal 46. The horizontal tube sections 44, 46 have opposed facing ends 48, 50 respectively. These hollow tube sections receive an extension tube 52 as seen in FIGS. 5 and 6. One end 54 of extension tube 52 is threaded into the end 48 of the horizontal section 44 of the display guard. The other end 56 of tube 52 is received in the end 50 of horizontal section 46 of the display guard. Tube 52 has an elongated slot 57 formed therein, as seen FIG. 6. A self-threading screw 58 or the like is mounted in one the end 50 of horizontal section 46 and passes into slot 58. By loosening the screw and adjusting the relative position of horizontal section 46 on tube 56, the horizontal extent of the display guard can be varied as desired, as shown in dotted lines in FIGS. 2 and 5.

The inclined portion 22 of display guard 10 includes a channel 60 mounted on its inner surface, as seen in FIG. 5. The channel can be screwed or tack welded in place. It has a pair of side walls 62 and a base 64. The glass shield 15 is slid into the channel from its open upper end and supported therein by side walls 62 and base 64. As noted above, a corresponding food display guard support on the opposite end of the display case supports the other side of shield 15.

Figure 7:
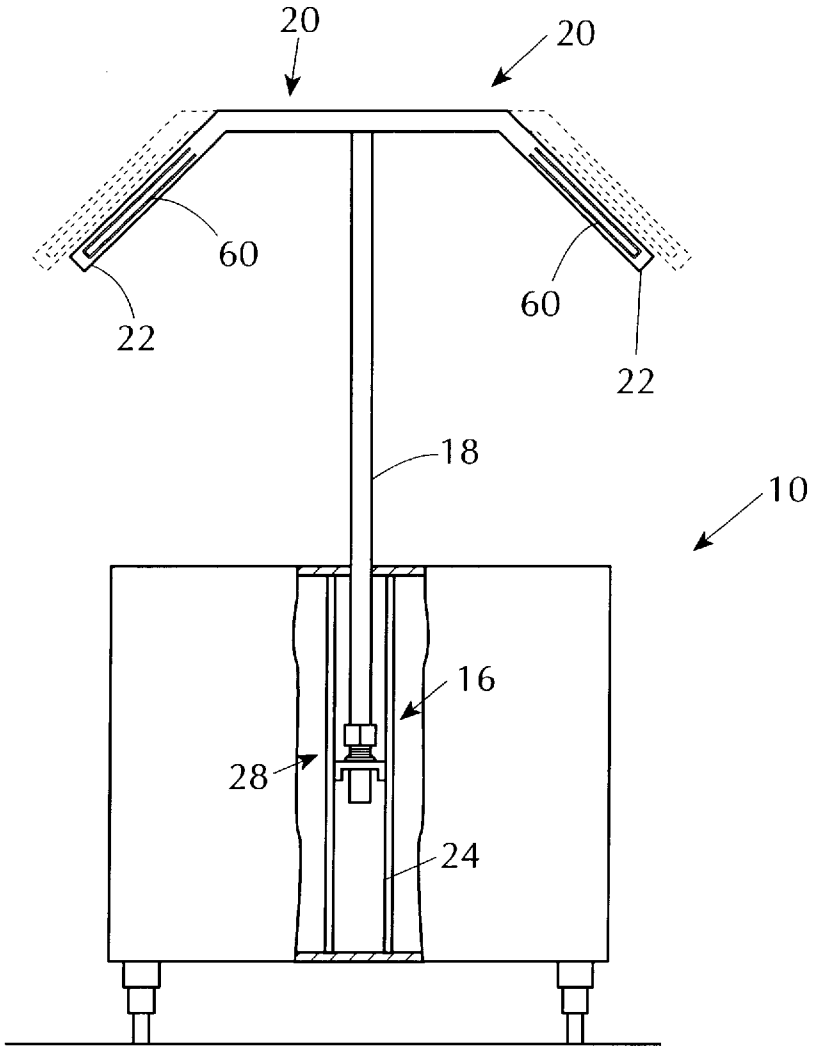
FIG. 7 is a side sectional view, similar to FIG. 2, showing another food display guard according to the invention for use with a two sided display case.

In the embodiment of the invention illustrated in FIG. 7, a dual display guard is illustrated for use in a display case which provides access to food therein from opposite sides. The display guard 10 in this embodiment has a vertical tube 18 corresponding to tube 18 previously described, and support means 16 mounted at each end of the display case 12. The upper end of the vertical tube has a pair of horizontal extensions mounted thereon, each of which is extendable through the same structure as described above with reference to FIGS. 5 and 6.

Although the embodiments of the invention have been described with reference to the accompanying drawings, it is to be understood that the invention is not limited to those precise embodiments, but that the various changes and modifications may be effected therein by those skilled in the art without the part of the scope or spirit of this invention.

I claim:

1. A food display guard comprising support means for securing the display guard to a display case, a vertical support, means for adjustably mounting the vertical support in said support means, a generally horizontal support member extending from said vertical support and including means for adjusting the length of the horizontal support member, a food protector plate, and means for mounting the food protector plate on said horizontal support member.

2. A food display guard as defined in claim 1 wherein said horizontal support includes an inclined free end portion and said means for mounting the food protector plate is mounted on said free end.

3. A food display guard as defined in claim 1 wherein said means for adjustably mounting the vertical support comprises a compression fitting mounted on said support means for receiving said vertical support and selectively locking the vertical support in a selected vertical position in said support means.

4. A food display guard as defined in claim 1 wherein said compression fitting includes a threaded compression member mounted on said support means receiving the vertical support and a threaded nut, threadedly engaged on the compression member for compressing the compression member on the vertical support when the nut is tightened on the compression member.

5. A food display guard as defined in claim 2 wherein said horizontal support member has first and second separate hollow horizontal sections and said adjusting means comprises an extension tube having opposed ends respectively received in said hollow horizontal sections.

6. A food display guard as defined in claim 5 wherein one of said opposed ends of said extension tube is threaded engaged in one of said hollow horizontal sections and the other end is adjustably positioned in the other hollow horizontal section.

7. A food display guard as defined in claim 6 wherein said extension tube has an elongated slot formed therein and means are provided for cooperation between said other hollow horizontal section and said slot for adjustably positioning said extension tube in said other hollow horizontal section.

8. A food display guard comprising support means for securing the display guard to a display case, a pair of spaced vertical support tubes, means for adjustably mounting the vertical support tubes in said support means, a generally horizontal support member extending from each of said vertical support tubes, means for adjusting the length of the generally horizontal support tubes, a food protector plate having opposed ends and means on said generally horizontal support tubes for mounting said opposed ends of said food protector plate therein.

9. A food display guard as defined in claim 8 wherein said horizontal support member has first and second separate hollow horizontal sections and said adjusting means comprises an extension tube having opposed ends respectively received in said hollow horizontal sections.

10. A food display guard as defined in claim 9 wherein one of said opposed ends of said extension tube is threadedly engaged in one of said hollow horizontal sections and the other end is adjustably positioned in the other hollow horizontal section.

11. A food display guard as defined in claim 10 wherein said extension tube has an elongated slot formed therein and means are provided for cooperation between said other hollow horizontal section and said slot for adjustably positioning said extension tube in said other hollow horizontal section.

12. A food display guard as defined in claim 11 wherein said means for adjustably mounting the vertical support tube comprises compression fitting means mounted on the support means for receiving said vertical support tube and selectively locking the vertical support tube in a selected vertical position.

* * * * *